US009409080B1

(12) United States Patent
Yang

(10) Patent No.: US 9,409,080 B1
(45) Date of Patent: Aug. 9, 2016

(54) EDUCATIONAL BALL

(71) Applicant: Ju-Hsun Yang, Taichung (TW)

(72) Inventor: Ju-Hsun Yang, Taichung (TW)

( * ) Notice: Subject to any disclaimer, the term of this patent is extended or adjusted under 35 U.S.C. 154(b) by 0 days.

(21) Appl. No.: 14/728,415

(22) Filed: Jun. 2, 2015

(51) Int. Cl.
*A63F 9/08* (2006.01)

(52) U.S. Cl.
CPC ..... *A63F 9/0826* (2013.01)

(58) Field of Classification Search
CPC ..... A63F 9/0826; A63F 9/083; A63F 9/838; A63F 9/0842; A63F 2009/0846; A63F 9/0865; A63F 9/0873
USPC ..... 273/153 S
See application file for complete search history.

(56) References Cited

U.S. PATENT DOCUMENTS 4,865,323 A * 9/1989 Heusinkveld ..... A63F 9/0857 273/153 S
5,215,305 A * 6/1993 Hsun ..... A63F 9/08 273/153 S
5,333,869 A * 8/1994 Hsun ..... A63F 9/0842 273/153 S
5,575,476 A * 11/1996 Yang ..... A63F 9/0842 273/153 S
5,816,571 A * 10/1998 Chen ..... A63F 9/0857 273/153 S
5,823,530 A * 10/1998 Yang ..... A63F 9/0865 273/153 S
5,836,584 A * 11/1998 Chen ..... A63F 9/0857 273/153 S
2005/0230908 A1* 10/2005 Perez Cabeza ..... A63F 9/0861 273/153 S
2009/0058001 A1* 3/2009 Cantner ..... A63F 9/0838 273/153 S

FOREIGN PATENT DOCUMENTS

FR EP 0512928 A1 * 11/1992 ..... A63F 9/083
IT EP 2441502 A1 * 4/2012 ..... A63F 9/083

* cited by examiner

*Primary Examiner* — Steven Wong
(74) *Attorney, Agent, or Firm* — Winthrow & Terranova, P.L.L.C.

(57) ABSTRACT

An educational ball has a body and multiple operating sets. The body is a square block and has six outer surfaces, six mounting recesses respectively formed in the outer surfaces, and six engaging holes respectively formed through the mounting recesses. The operating sets are connected to the body, are respectively and rotatably mounted in the mounting recesses, and each one of the operating sets has a rotating mount, two covering plates, a sliding groove, and multiple sliding sheets. The rotating mount is rotatably mounted in a corresponding mounting recess, and has an engaging jacket and two inserting holes. The covering plates are connected to the rotating mount, and each covering plate has a connecting pipe, multiple track grooves, and a guiding channel. The sliding sheets are movably mounted in the track grooves of the covering plates and the sliding groove of the operating set to cover the rotating mount.

13 Claims, 9 Drawing Sheets

EDUCATIONAL BALL

BACKGROUND OF THE DISCLOSURE

1. Field of the Disclosure

The present disclosure relates to an educational ball, and more particularly to an educational ball that can increase fun and challenge of using the educational ball and can provide multiple spatial arrangements.

2. Description of Related Art

With the ever-changing technology, currently multiple kinds of conventional educational products can be availed to train mental, spatial concepts and logical thinking. However, the conventional educational products mostly have only a single specific mode of arrangement or a single spatial arrangement of structure, and this cannot enhance interest and attraction for users to use the conventional educational products. In addition, the specific arrangement or the single array structure of the conventional educational products also reduce the challenge of the conventional educational products, and this may reduce the training effect of mental, spatial concepts and logical thinking for the users.

To overcome the shortcomings, the present disclosure provides an educational ball to mitigate or obviate the aforementioned problems.

SUMMARY OF THE DISCLOSURE

The main objective of the present disclosure is to provide an educational ball that can increase fun and challenge of using the educational ball and can provide multiple spatial arrangements.

The educational ball in accordance with the present disclosure has a body and multiple operating sets. The body is a square block and has six outer surfaces, six mounting recesses respectively formed in the outer surfaces, and six engaging holes respectively formed through the mounting recesses. The operating sets are connected to the body, are respectively and rotatably mounted in the mounting recesses, and each one of the operating sets has a rotating mount, two covering plates, a sliding groove, and multiple sliding sheets. The rotating mount is rotatably mounted in a corresponding mounting recess, and has an engaging jacket and two inserting holes. The covering plates are connected to the rotating mount, and each of the covering plates has a connecting pipe, multiple track grooves, and a guiding channel. The sliding sheets are movably mounted in the track grooves of the covering plates and the sliding groove of the operating set to cover the rotating mount.

Other objectives, advantages and novel features of the disclosure will become more apparent from the following detailed description when taken in conjunction with the accompanying drawings.

DETAILED DESCRIPTION OF THE PREFERRED EMBODIMENT

Figure 1:
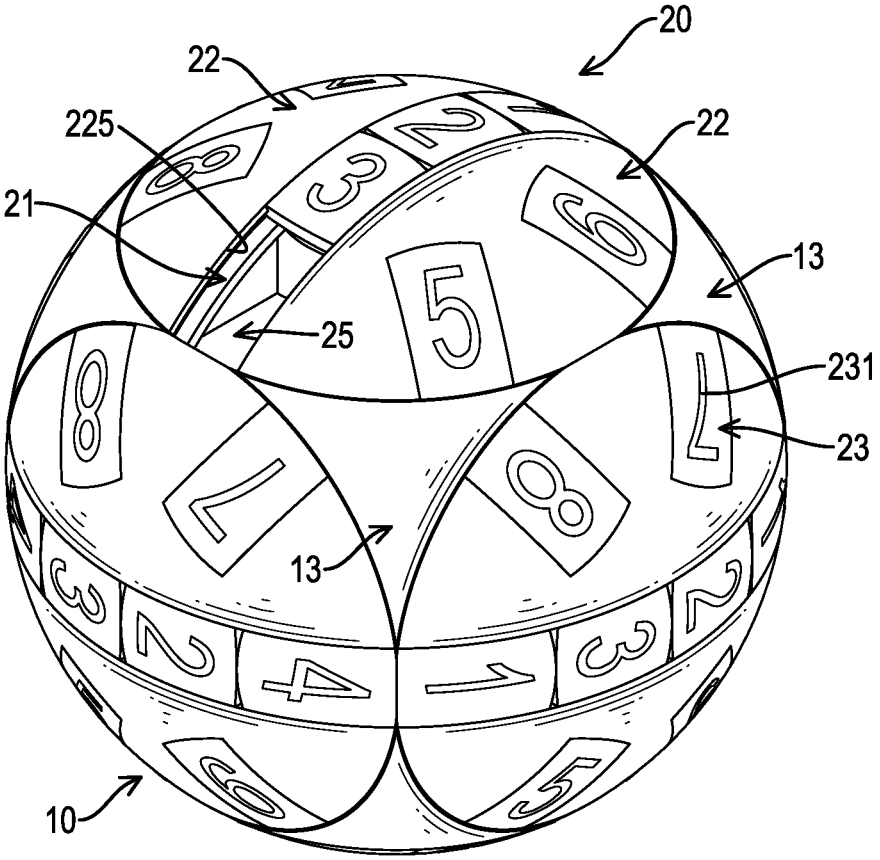
FIG. 1 is a perspective view of a first embodiment of an educational ball in accordance with the present disclosure.
Figures 2A, 2B:
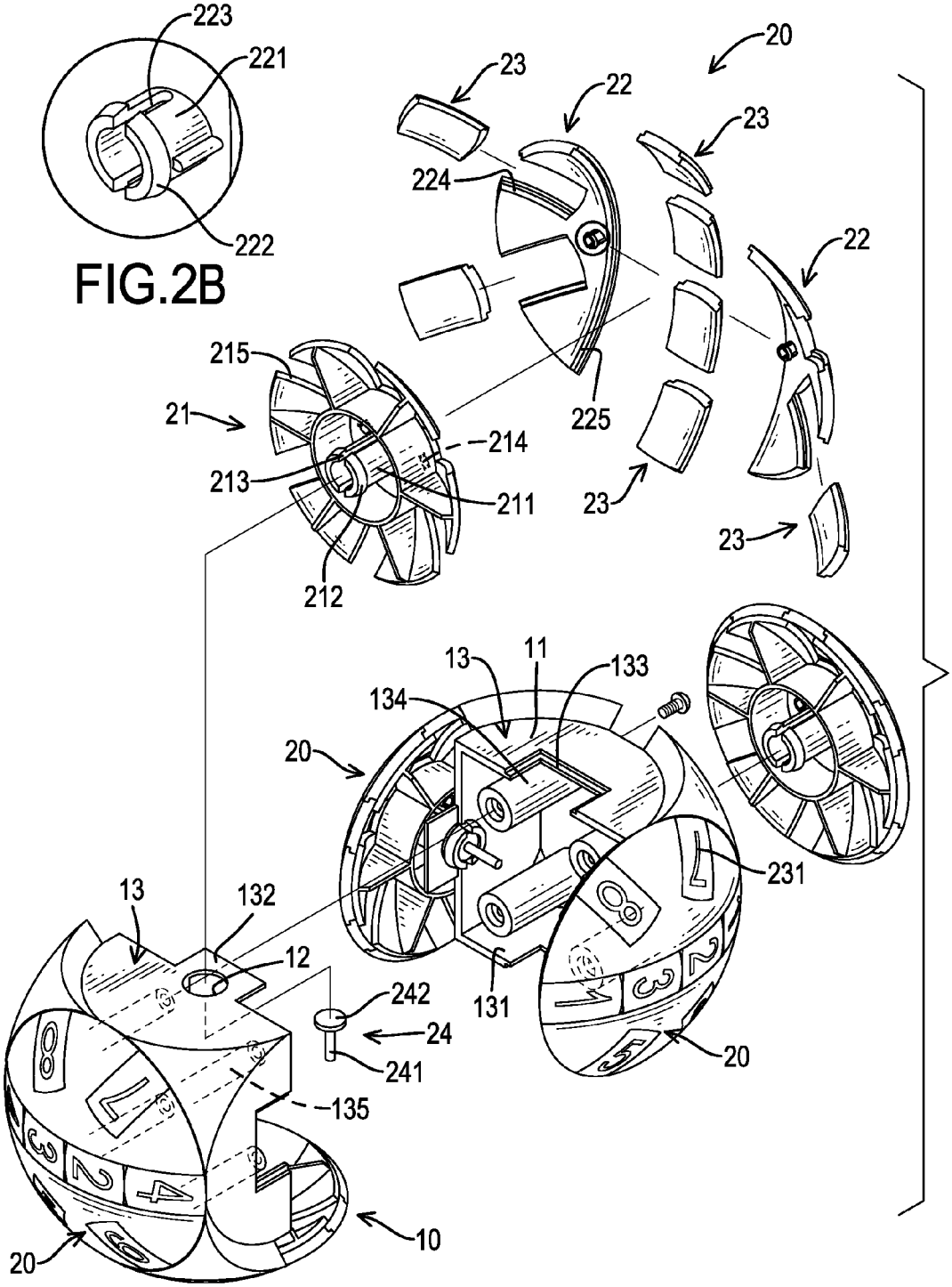
FIG. 2A is an exploded perspective view of the educational ball in FIG. 1.
FIG. 2B is an enlarged perspective view of a covering plate of the educational ball in FIG. 2A.

With reference to FIGS. 1 and 2A, a first embodiment of an educational ball in accordance with the present disclosure has a body 10 and multiple operating sets 20.

The body 10 is a square block and has six outer surfaces, six mounting recesses 11, and six engaging holes 12. The outer surfaces are connected to each other to form the square body 10. The mounting recesses 11 are respectively formed in the outer surfaces of the body 10, and each one of the mounting recesses 11 has a center. The engaging holes 12 are respectively formed through the centers of the mounting recesses 11.

Preferably, the body 10 is composed of two half-casings 13, the half-casings 13 are connected to each other, and each one of the half-casings 13 is hollow and has an inner side, an external surface, an opening 131, two connecting tabs 132, and two connecting recesses 133. The inner sides of the half-casings 13 face and contact each other, and each inner side has four edges. The opening 131 is formed through the inner side of the half-casing 13 between the four edges of the inner side of the half-casing 13. The two connecting tabs 132 are formed on and protrude from two of the four edges of the inner side of the half-casing 13, and face to each other. In addition, the connecting recesses 133 are formed in the other two edges of the inner side of the half-casing 13.

As the half-casings 13 are connected to each other to form the square body 10, the connecting tabs 132 and the connecting recesses 133 of one of the half-casings 13 are respectively connected to the connecting recesses 133 and the connecting tabs 132 of the other half-casing 13. Preferably, one of the half-casings 13 has multiple mounting tubes 134 formed in and protruding outwardly from the half-casing 13 and extending to the opening 131 of the half-casing 13, and the other half-casing 13 has multiple inserting posts 135 formed in and protruding outwardly from the half-casing 13. The inserting posts 135 are respectively mounted in and connected to the mounting tubes 134 to connect the half-casings 13 securely with each other. Furthermore, four of the engaging holes 12 are formed through the four connecting tabs 132 of the half-casings 13, and the other two engaging holes 12 are respectively formed through the half-casings 13 opposite to the openings 131 of the half-casings 13.

With reference to FIGS. 2A and 2B, the operating sets 20 are connected to the body 10, are respectively and rotatably mounted in the mounting recesses 11, and each one of the operating sets 20 has a rotating mount 21, two covering plates 22, and multiple sliding sheets 23.

The rotating mount 21 is round, is rotatably mounted in a corresponding mounting recess 11 of the body 10, and has an inner side, an outer side, an outer periphery, an engaging jacket 211, an engaging ring 212, two cutting slots 213, two inserting holes 214, and multiple notches 215. The engaging jacket 211 is formed on and protrudes from the inner side of the rotating mount 21, extends in one of the outer surfaces of the body 10, and engages one of the engaging holes 12 to hold the rotating mount 21 in the corresponding mounting recess 11 of the body 10. The engaging jacket 211 is hollow and has a free end and an external surface. The free end of the engaging jacket 211 extends in the body 10 via a corresponding engaging hole 12. The engaging ring 212 is formed on and protrudes from the external surface of the engaging jacket 211 at the free end, and abuts against the corresponding outer surface of the body 10.

The cutting slots 213 are axially formed through the external surface of the engaging jacket 211 and the engaging ring 212 to enable the engaging jacket 211 to deform relative to the corresponding engaging hole 12 of the body 10. Then, the engaging ring 212 can be passed through the corresponding engaging hole 12 to abut against the corresponding outer surface of the body 10 to hold the rotating mount 21 in the corresponding mounting recess 11. The inserting holes 214 are formed through the outer side of the rotating mount 21 beside the engaging jacket 211. The notches 215 are formed through the outer side and the inner side of the rotating mount 21 at the outer periphery of the rotating mount 21 and are spaced apart from each other at intervals, and each one of the notches 215 has a width.

Figure 3:
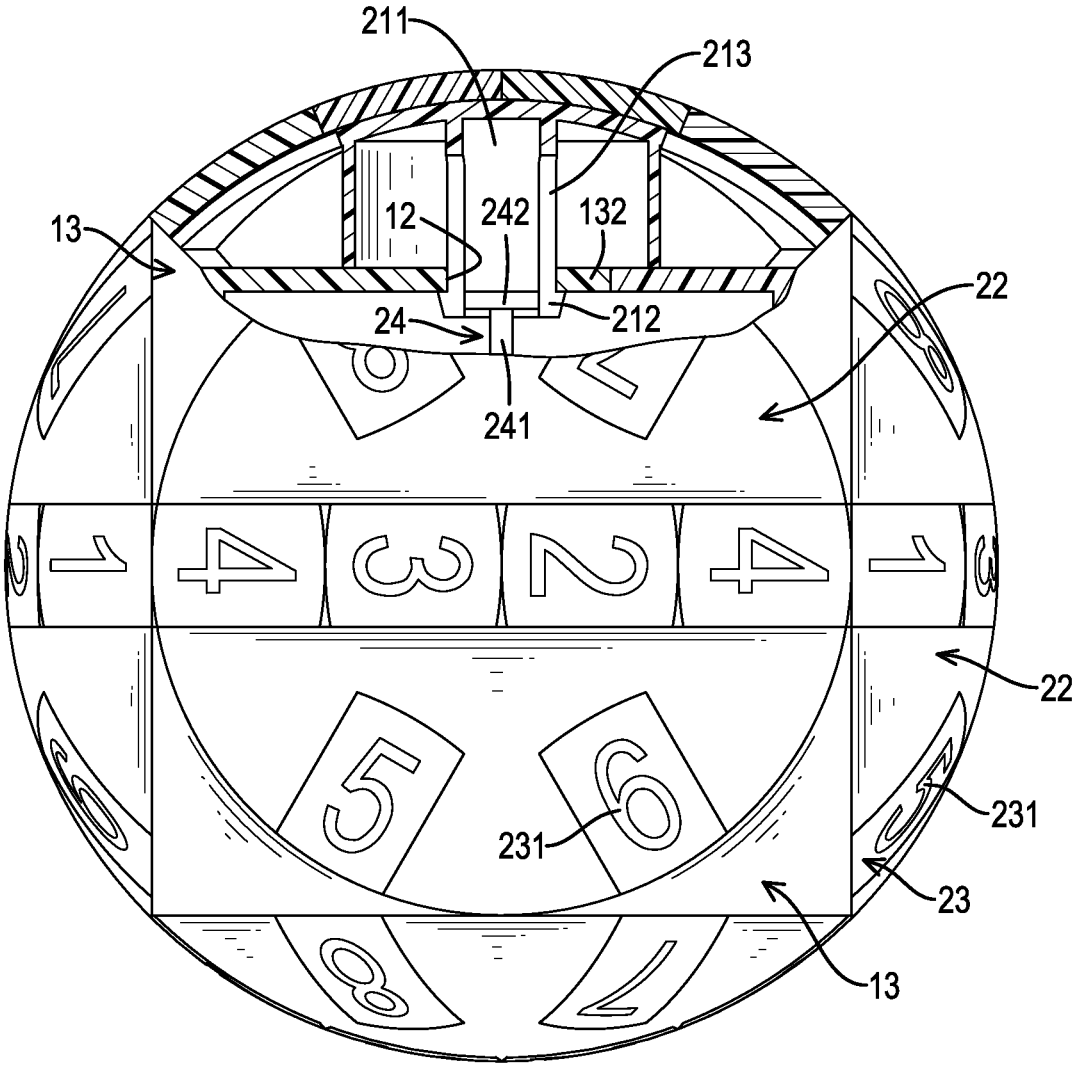
FIG. 3 is a partial cross-sectional front side view of the educational ball in FIG. 1.

Preferably, with reference to FIGS. 2A and 3, when the engaging jacket 211 securely engages the corresponding engaging hole 12 by the engaging ring 212, each operating set 20 further has a T-shaped limiting element 24 mounted in and abutting against the engaging jacket 211 via the free end of the engaging jacket 211 to prevent the engaging jacket 211 from deforming relative to the engaging hole 12 to hold the rotating mount 21 securely on the corresponding outer surface of the body 10. The limiting element 24 has a pushing rod 241 and a limiting board 242. The pushing rod 241 has an end. The limiting board 242 is transversally formed on the end of the pushing rod 241 to form the T-shaped limiting element 24, and is mounted in and abuts against the engaging jacket 211 to enable the engaging ring 212 to abut against the body 10 at the corresponding engaging hole 12.

Figure 4:
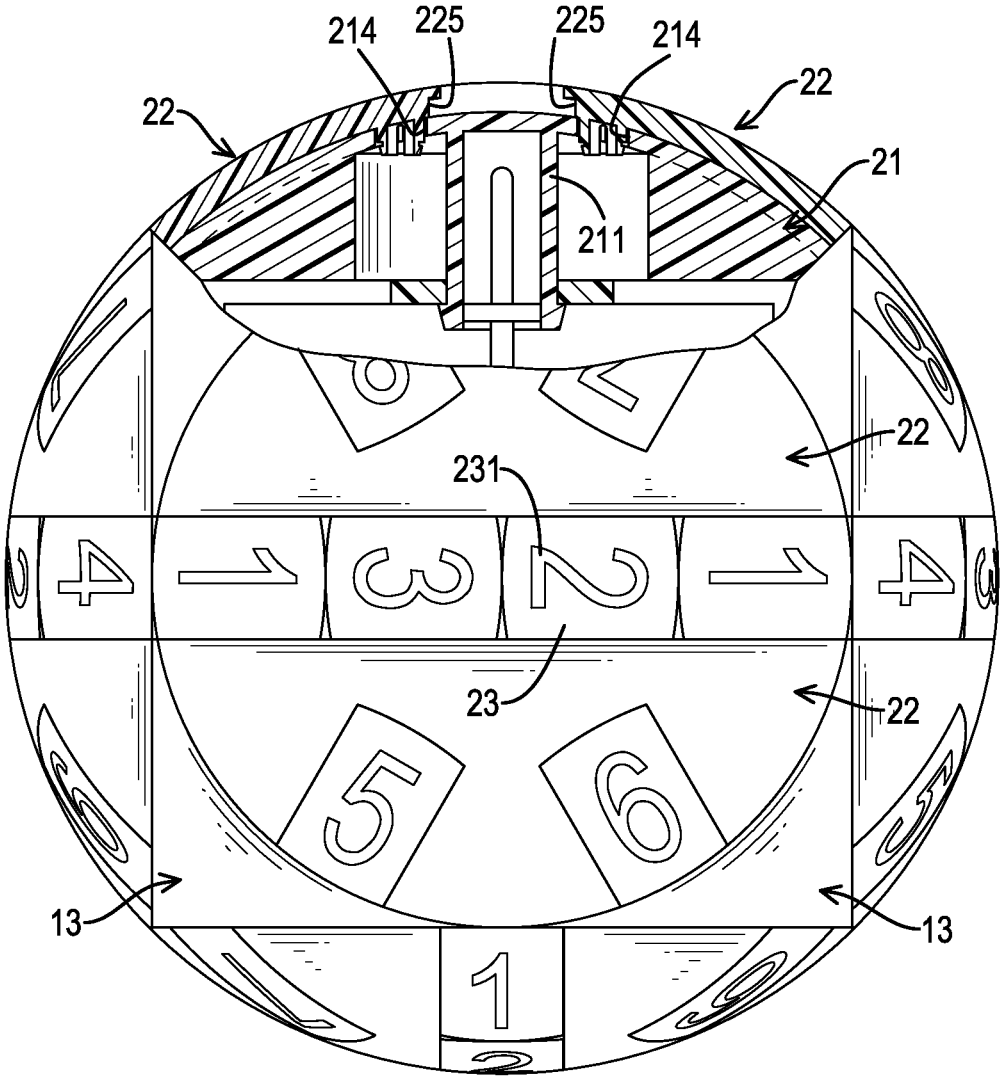
FIG. 4 is a partial cross-sectional side view of the educational ball in FIG. 1.

With reference to FIGS. 2A, 2B and 4, the two covering plates 22 are connected to the rotating mount 21 at an interval to cover the outer side of the rotating mount 21, and each one of the covering plates 22 is semi-circular and has an inner surface, a flat inner edge, a curved outer edge, an outer side, a connecting pipe 221, an abutting ring 222, two cutting grooves 223, multiple track grooves 224, and a guiding channel 225.

The inner surface of the covering plate 22 covers a part of the outer side of the rotating mount 21. The flat inner edge of the covering plate 22 faces the flat inner edge of the other covering plate 22 at an interval. The connecting pipe 221 is formed on and protrudes from the inner surface of the covering plate 22, extends in the outer side of the rotating mount 21, and engages one of the inserting holes 214 to hold the covering plate 22 with the rotating mount 21. The connecting pipe 221 is hollow and has a free end and an external surface. The free end of the connecting pipe 221 extends in the rotating mount 21 via a corresponding inserting hole 214. The abutting ring 222 is formed on and protrudes from the external surface of the connecting pipe 221 at the free end, and abuts against the inner side of the rotating mount 21.

The cutting grooves 223 are axially formed through the external surface of the connecting pipe 221 and the abutting ring 222 to enable the connecting pipe 221 to deform relative to the corresponding inserting hole 214 of the rotating mount 21. Then, the abutting ring 222 can be passed through the corresponding inserting hole 214 to abut against the inner side of the rotating mount 21 to hold the covering plate 22 with the rotating mount 21. The track grooves 224 are formed through the curved outer edge of the covering plate 22, are space apart from each other at intervals, align with some of the notches 215 of the rotating mount 21, and each one of the track grooves 224 has a width. The width of the track groove 224 is wider than the width of a corresponding notch 215 of the rotating mount 21. The guiding channel 225 is formed in the flat inner edge of the covering plate 22. In addition, each one of the track grooves 224 of the operating set 20 communicates with one of the track grooves 224 of one of the adjacent operating sets 20.

With reference to FIG. 1, when the covering plates 22 are mounted on the rotating mount 21, the operating set 20 has a sliding groove 25 formed between the guiding channels 225 of the covering plates 22, and the sliding groove 25 aligns with two of the notches 215 of the rotating mount 21. That is, the notches 215 of the rotating mount 21 align with the sliding groove 25 and the track grooves 224 of the covering plates 22. Furthermore, the sliding groove 25 of the operating set 20 communicates with the two sliding grooves 25 of two of the adjacent operating sets 20. Preferably, each one of the covering plates 22 has a color.

Figure 8:
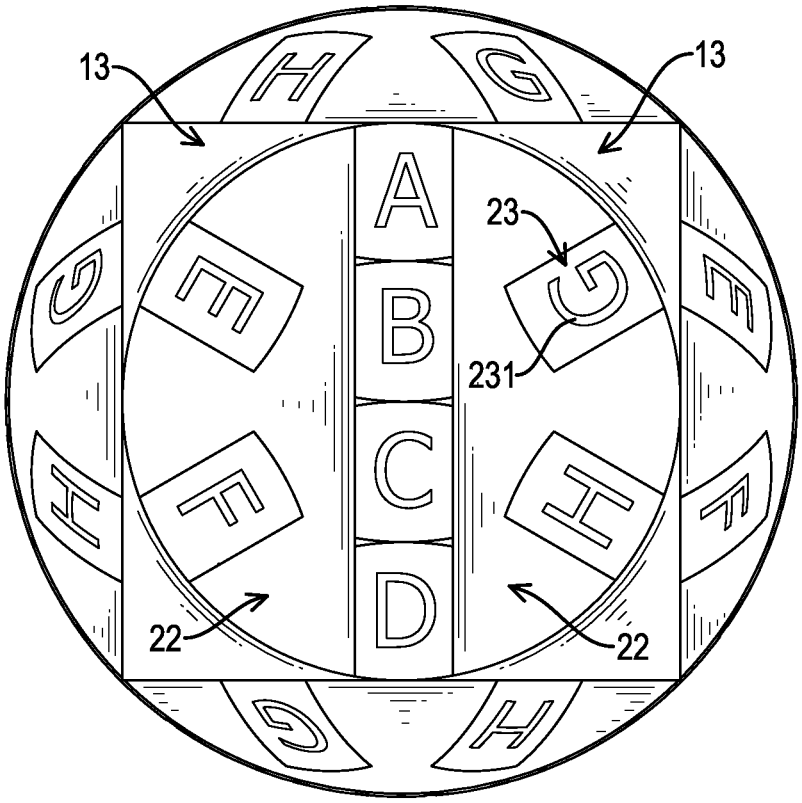
FIG. 8 is a top view of a second embodiment of an educational ball in accordance with the present disclosure.

The sliding sheets 23 are movably mounted in the track grooves 224 of the covering plates 22 and the sliding groove 25 of the operating set 20 to cover the rotating mount 21. Each one of the sliding sheets 23 is a curved and rectangular sheet and has an outer surface and a mark 231. The outer surface of the sliding sheet 23 is exposed from one of the track grooves 224 or the sliding groove 25 of the operating set 20. The mark 231 is formed on the outer surface of the sliding sheet 23, and the mark 231 can be a numeral or an English alphabet as shown in FIG. 8.

Additionally, the mark 231 of the sliding sheet also can be a pattern of Chinese Animal Zodiac, Constellations, Poker or Numerology. Furthermore, the outer surface and the mark 231 of the sliding sheet 23 have different colors. Preferably, the color of the outer surface of the sliding sheet 23 is same or different from the colors of the two covering plates 22. The amount of the sliding sheets 23 of one of the operating sets 20 is fewer than amount of the other operating sets 20 to form a gap on the operating set 20, and this can enable the sliding sheets 23 of the operating set 20 to move to another operating set 20 via the gap.

Figure 5:
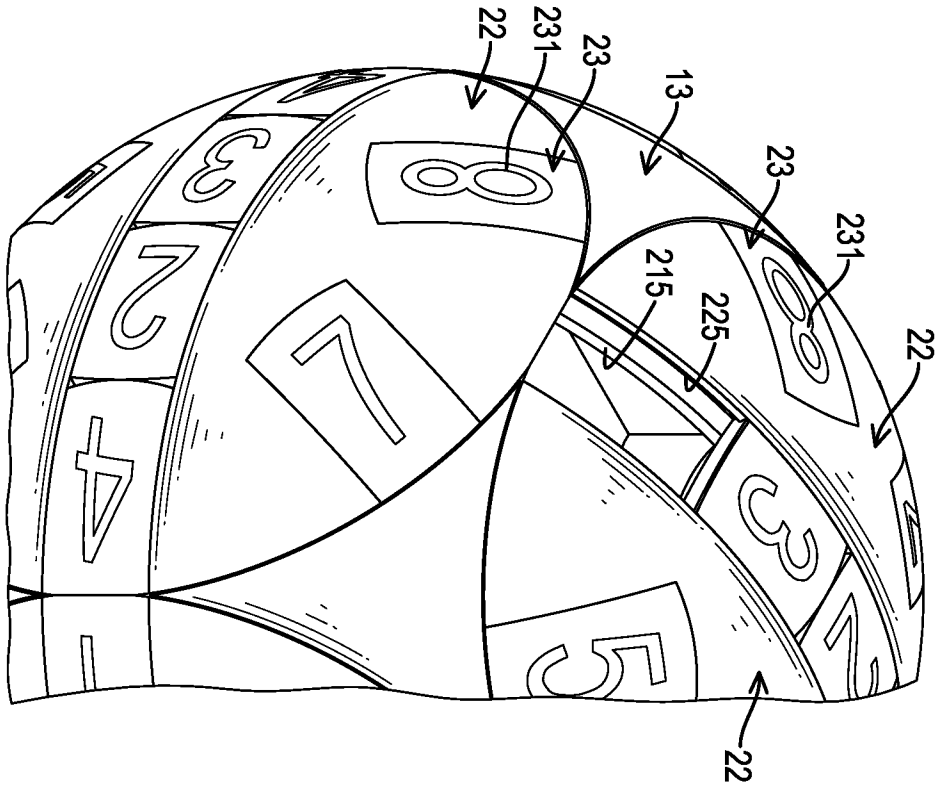
FIG. 5 is an enlarged perspective view of the educational ball in FIG. 1.
Figure 6:
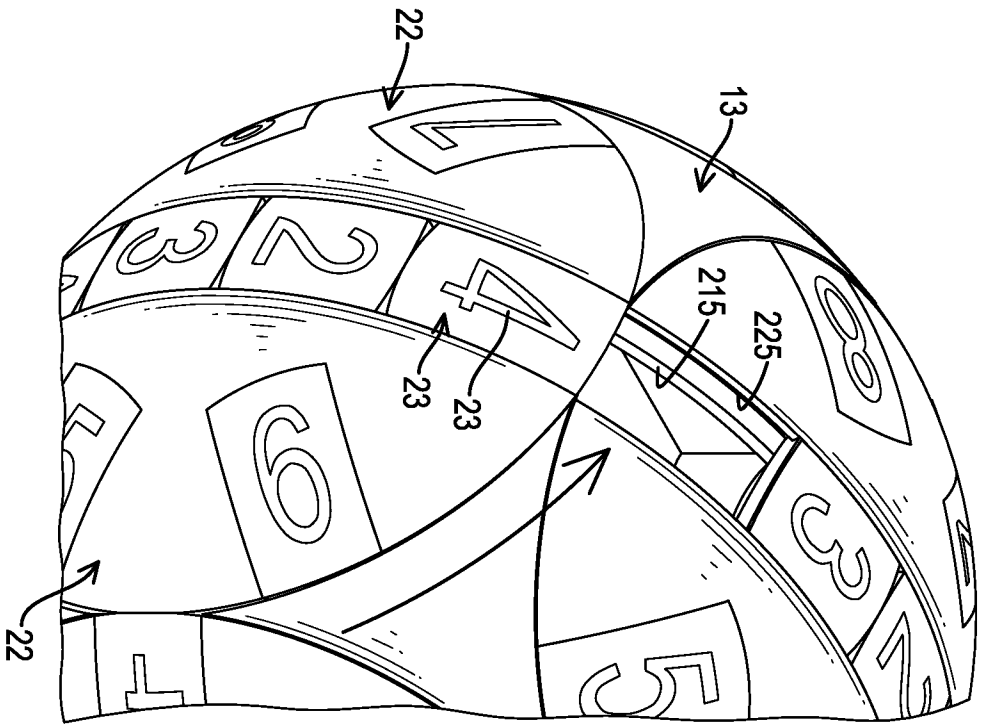
FIGS. 6 and 7 are enlarged and operational perspective views of the educational ball in FIG. 1.
Figure 7:
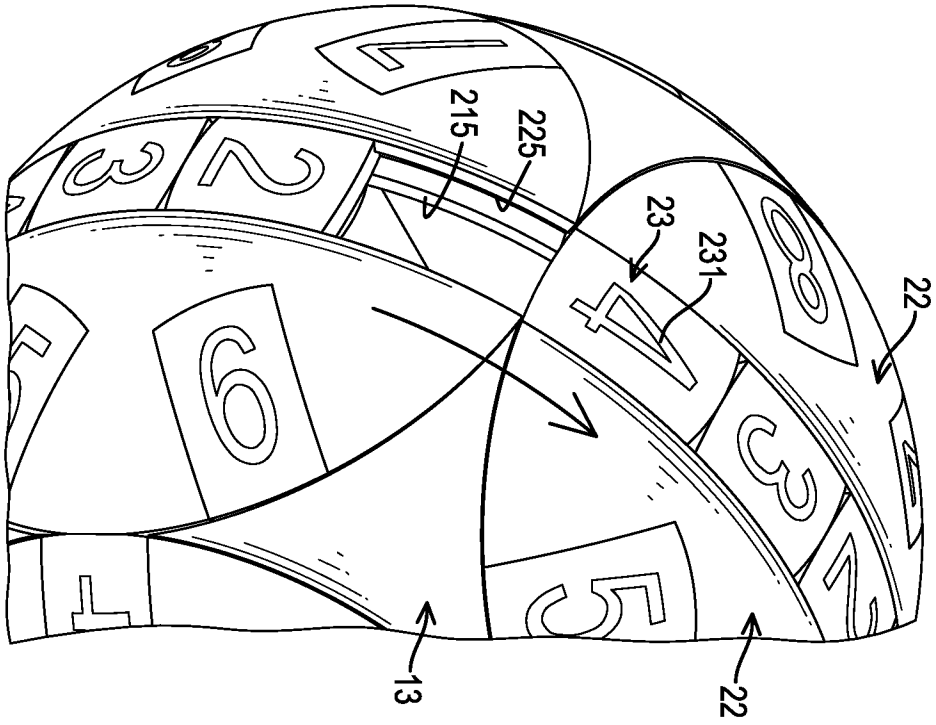

In use, with reference to FIG. 5, a user can turn the educational ball over to enable the operating set 20 that has fewer sliding sheets 23 to move to a top of the educational ball. In the first embodiment of an educational ball, the gap is formed in the sliding groove 25 of the corresponding operating set 20. With reference to FIG. 6, the user can rotate one of the adjacent operating sets 20 to enable one of the sliding sheets 23 of the adjacent operating set 20 to align with the gap. Then, the user can push the corresponding sliding sheet 23 to move into the gap to fill the sliding groove 25 of the operating set 20 that has fewer sliding sheets 23 as shown in FIG. 7, and the gap is moved and formed on the adjacent operating set 20.

According to the above-mentioned operation, the user also can rotate two adjacent operating sets 20 to enable the gap to align with one of the track grooves 224 of one of the two adjacent operating sets 20 to form different spatial arrangements. In addition, each one of the operating sets 20 can be rotated relative to the four adjacent operating sets 20 to move the sliding sheets 23 between the operating sets 20. Furthermore, the user can move the sliding sheets 23 in the track grooves 224 annularly according to the order and sequence of numerals or English alphabets or move the sliding sheets 23 in the sliding grooves 25 to align with each other according to the order and sequence of numerals or English alphabets. In addition, the user also can push the sliding sheets 23 with same colors to move in the track grooves 224 and the sliding groove 25 of one of the operating sets 20. Therefore, the educational ball in accordance with the present disclosure can provide different spatial arrangements and modes of operation, and this can increase operational variability, fun and challenge of using the educational ball. Then, the training effect of mental, spatial concepts and logical thinking for the users can be improved by the educational ball of the present disclosure.

With reference to FIG. 8, a second embodiment of an educational ball in accordance with the present disclosure is substantially the same as the first embodiment except for the following features. Only one of the operating sets 20 has a sliding groove 25, and the mark 231 of each one of the sliding sheets 23 is an English alphabet.

Figure 9:
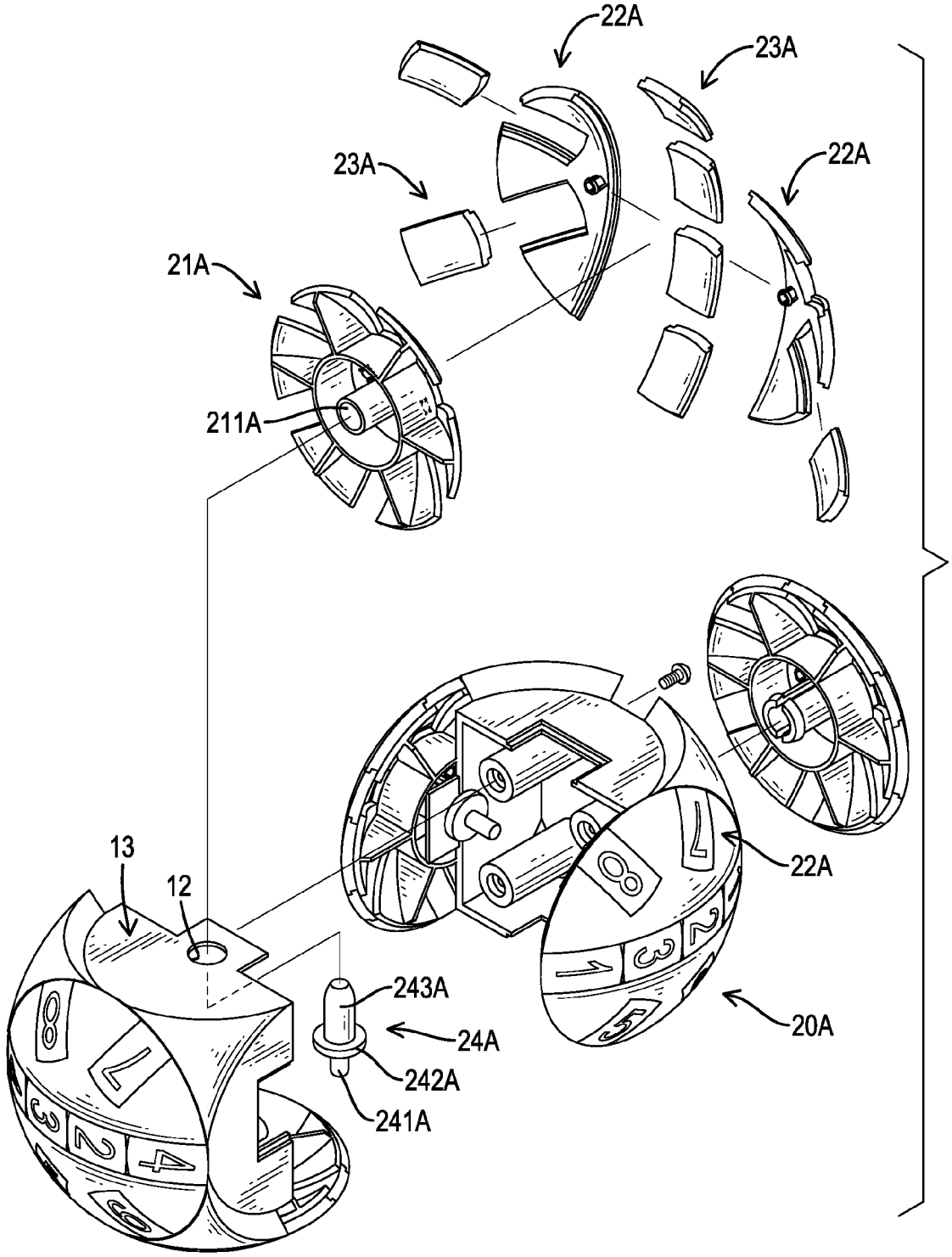
FIG. 9 is an exploded perspective view of a third embodiment of an educational ball in accordance with the present disclosure.

With reference to FIG. 9, a third embodiment of an educational ball in accordance with the present disclosure is substantially the same as the first embodiment except for the following features. Each rotating mount 21A of the operating sets 20A does not have the engaging ring 212 and the cutting slots 213, and the engaging jacket 211 cannot be deformed. In addition, each limiting element 24A further has an engaging head 243A formed on the limiting board 242A opposite to the pushing rod 241A. The engaging head 243A is resilient and is securely mounted in the engaging jacket 211A to enable the limiting board 242A to abut against the body 10. Then, the rotating mount 21A can be mounted on the corresponding mounting recess 11 of the body 10. Preferably, glue is coated on the engaging head 243A and is connected to the engaging jacket 211A to increase the structural strength between the rotating mount 21A and the body 10.

Even though numerous characteristics and advantages of the present disclosure have been set forth in the foregoing description, together with details of the structure and features of the disclosure, the disclosure is illustrative only. Changes may be made in the details, especially in matters of shape, size, and arrangement of parts within the principles of the disclosure to the full extent indicated by the broad general meaning of the terms in which the appended claims are expressed.

What is claimed is:

1. An educational ball having:

a body being a square block and having six outer surfaces connected to each other to form the body;

six mounting recesses respectively formed in the outer surfaces of the body, and each one of the mounting recesses having a center; and six engaging holes respectively formed through the centers of the mounting recesses; and multiple operating sets connected to the body, respectively and rotatably mounted in the mounting recesses, and each one of the operating sets having a rotating mount rotatably mounted in a corresponding mounting recess of the body, and having an inner side;

an outer side;

an outer periphery;

an engaging jacket formed on and protruding from the inner side of the rotating mount, extending in one of the outer surfaces of the body, and engaging one of the engaging holes; and two inserting holes formed through the outer side of the rotating mount beside the engaging jacket;

two covering plates connected to the rotating mount at an interval to cover the outer side of the rotating mount, and each one of the covering plates having an inner surface covering a part of the outer side of the rotating mount;

a flat inner edge facing the flat inner edge of the other covering plate at an interval;

a curved outer edge;

an outer side;

a connecting pipe formed on and protruding from the inner surface of the covering plate, extending in the outer side of the rotating mount, and engaging one of the inserting holes to hold the covering plate with the rotating mount;

multiple track grooves formed through the curved outer edge of the covering plate and spaced apart from each other at intervals; and a guiding channel formed in the flat inner edge of the covering plate; and a sliding groove formed between the guiding channels of the covering plates;

multiple sliding sheets movably mounted in the track grooves of the covering plates and the sliding groove of the operating set to cover the rotating mount, and each one of the sliding sheets being curved and having an outer surface exposed from one of the track grooves or the sliding groove of the operating set;

a mark formed on the outer surface of the sliding sheet; and wherein amount of the sliding sheets of one of the operating sets is fewer than amount of the other operating sets to form a gap on a corresponding operating set.

2. The educational ball as claimed in claim 1, wherein the body is composed of two half-casings, the half-casings are connected to each other, and each one of the half-casings is hollow and has an inner side facing and contacting the inner side of the other half-casing, and the inner side having four edges;

an opening formed through the inner side of the half-casing between the four edges of the inner side of the half-casing;

two connecting tabs formed on and protruding from two of the four edges of the inner side of the half-casing, and facing to each other; and two connecting recesses formed in the other two edges of the inner side of the half-casing; and wherein the half-casings are connected to each other to form the square body, the connecting tabs and the connecting recesses of one of the half-casings are respectively connected to the connecting recesses and the connecting tabs of the other half-casing.

3. The educational ball as claimed in claim 2, wherein four of the engaging holes are formed through the four connecting tabs of the half-casings, and the other two engaging holes are respectively formed through the half-casings opposite to the openings of the half-casings; and the mounting recesses are formed in two external surfaces of the half-casings.

4. The educational ball as claimed in claim 3, wherein one of the half-casings has multiple mounting tubes formed in and protruding outwardly from the half-casing and extending to the opening of the half-casing; and the other half-casing has multiple inserting posts formed in and protruding outwardly from the half-casing and respectively mounted in and connected to the mounting tubes to connect the half-casings securely with each other.

5. The educational ball as claimed in claim 4, wherein
the engaging jacket of the rotating mount of each one of the operating sets is hollow and has
a free end extending in the body via a corresponding engaging hole; and
an external surface;
the rotating mount of each one of the operating sets has
an engaging ring formed on and protruding from the external surface of the engaging jacket at the free end of the engaging jacket, and abutting against a corresponding outer surface of the body; and
two cutting slots axially formed through the external surface of the engaging jacket and the engaging ring to enable the engaging jacket to deform relative to the corresponding engaging hole of the body.

6. The educational ball as claimed in claim 5, wherein
the rotating mount of each one of the operating sets has multiple notches formed through the outer side and the inner side of the rotating mount at the outer periphery of the rotating mount and spaced apart from each other at intervals, and each one of the notches having a width;
each track groove of each one of the covering plates of each one of the operating sets has a width wider than the width of one of the notches of a corresponding rotating mount that is connected to the covering plates; and
the track grooves of the two covering plates and the sliding groove of each one of the operating sets align with the notches of the rotating mount of the corresponding operating set.

7. The educational ball as claimed in claim 6, wherein
the connecting pipe of each covering plate of each one of the operating sets has
a free end extending in the rotating mount via a corresponding inserting hole; and
an external surface; and
each covering plate of each one of the operating sets has
an abutting ring formed on and protruding from the external surface of the connecting pipe at the free end of the connecting pipe, and abutting against the inner side of the rotating mount; and
two cutting grooves axially formed through the external surface of the connecting pipe and the abutting ring to enable the connecting pipe to deform relative to the corresponding inserting hole of the rotating mount.

8. The educational ball as claimed in claim 7, wherein
the outer surface of each one of the sliding sheets of each one of the operating sets has a color; and
the mark of each one of the sliding sheets of each one of the operating sets has a color different from the color of the outer surface of the sliding sheet.

9. The educational ball as claimed in claim 8, wherein each covering plate of each one of the operating sets has a color different from the colors of the outer surfaces of the sliding sheets of the corresponding operating set.

10. The educational ball as claimed in claim 1, wherein
the rotating mount of each one of the operating sets has multiple notches formed through the outer side and the inner side of the rotating mount at the outer periphery of the rotating mount and spaced apart from each other, and each one of the notches having a width;
each track groove of each one of the covering plates of each one of the operating sets has a width wider than the width of one of the notches of a corresponding rotating mount that is connected to the covering plates; and
the track grooves of the two covering plates and the sliding groove of each one of the operating sets align with the notches of the rotating mount of the corresponding operating set.

11. The educational ball as claimed in claim 2, wherein
the rotating mount of each one of the operating sets has multiple notches formed through the outer side and the inner side of the rotating mount at the outer periphery of the rotating mount and spaced apart from each other, and each one of the notches having a width;
each track groove of each one of the covering plates of each one of the operating sets has a width wider than the width of one of the notches of a corresponding rotating mount that is connected to the covering plates; and
the track grooves of the two covering plates and the sliding groove of each one of the operating sets align with the notches of the rotating mount of the corresponding operating set.

12. The educational ball as claimed in claim 3, wherein
the rotating mount of each one of the operating sets has multiple notches formed through the outer side and the inner side of the rotating mount at the outer periphery of the rotating mount and spaced apart from each other, and each one of the notches having a width;
each track groove of each one of the covering plates of each one of the operating sets has a width wider than the width of one of the notches of a corresponding rotating mount that is connected to the covering plates; and
the track grooves of the two covering plates and the sliding groove of each one of the operating sets align with the notches of the rotating mount of the corresponding operating set.

13. The educational ball as claimed in claim 4, wherein
the rotating mount of each one of the operating sets has multiple notches formed through the outer side and the inner side of the rotating mount at the outer periphery of the rotating mount and spaced apart from each other, and each one of the notches having a width;
each track groove of each one of the covering plates of each one of the operating sets has a width wider than the width of one of the notches of a corresponding rotating mount that is connected to the covering plates; and
the track grooves of the two covering plates and the sliding groove of each one of the operating sets align with the notches of the rotating mount of the corresponding operating set.

* * * * *